US011674662B1

(12) United States Patent
Yeh

(10) Patent No.: US 11,674,662 B1
(45) Date of Patent: Jun. 13, 2023

(54) VEHICLE LAMP

(71) Applicant: Neng-Chen Yeh, Tainan (TW)

(72) Inventor: Neng-Chen Yeh, Tainan (TW)

( * ) Notice: Subject to any disclaimer, the term of this patent is extended or adjusted under 35 U.S.C. 154(b) by 0 days.

(21) Appl. No.: 17/899,895

(22) Filed: Aug. 31, 2022

(51) Int. Cl.
*F21S 45/20* (2018.01)
*F21S 45/60* (2018.01)
*F21S 41/141* (2018.01)

(52) U.S. Cl.
CPC ..... *F21S 45/20* (2018.01); *F21S 41/141* (2018.01); *F21S 45/60* (2018.01)

(58) Field of Classification Search
CPC ..... F21S 45/20; F21S 45/60
See application file for complete search history.

(56) References Cited

U.S. PATENT DOCUMENTS

2021/0270442 A1* 9/2021 Kim ..... F21S 45/435

* cited by examiner

*Primary Examiner* — Sean P Gramling
(74) *Attorney, Agent, or Firm* — Bacon & Thomas, PLLC

(57) ABSTRACT

A vehicle lamp has a lamp housing, a light-emitting device, a fan, and an auxiliary heater located within the lamp housing. The lamp housing has a lamp cover and an airflow circulating structure inside the lamp housing to form a circulation passage therein. The circulation passage corresponds to a main transmitting area of the lamp cover in position. Airflow, generated by the fan, inside the circulation passage is heated by the auxiliary heater and at least one light-emitting diode module of the light-emitting device. The main transmitting area is heated by heated airflow. Accordingly, the snow attached onto the main transmitting area are is removed rapidly and efficiently to let light emitted by the light-emitting device pass through the main transmitting area free from being blocked by the snow.

8 Claims, 4 Drawing Sheets

VEHICLE LAMP

BACKGROUND OF THE INVENTION

1. Field of the Invention

The present invention relates to a luminous device, and more particularly to a vehicle lamp.

2. Description of Related Art

A conventional vehicle lamp has a lamp housing and a light-emitting device mounted in the lamp housing. The lamp housing has a lamp base and a lamp cover assembled to each other. The light-emitting device is controlled to emit light for illumination or warning. The lamp cover is transparent and covers the light-emitting device to protect the light-emitting device.

The conventional vehicle lamp is applied on a motor vehicle to provide functions of illumination or warning. However, in a snowy environment, snow easily attaches to the lamp cover. The light emitted by the vehicle lamp is blocked by the snow attached to the lamp cover accordingly. In order to prevent the light emitted by the vehicle lamp from being blocked by the snow attached to the lamp cover, the conventional vehicle lamp further has multiple heating wires to electrically heat the lamp cover for melting the snow attached thereto. The vehicle lamp can normally function to emit light in the snowy environment accordingly.

In the above mentioned conventional vehicle lamp, the lamp cover is heated to remove the snow by the multiple heating wires mounted to the lamp cover. However, the conventional vehicle lamp with heating wires mounted to the lamp cover has problems of uneven heating and slow heat transfer. The applicant of the present invention equips a hot airflow generating mechanism inside the lamp cover to generate hot airflow inside the lamp cover all over for melting the snow attached to the lamp cover and keep the vehicle lamp normally functioning in the snowy environment.

Although the above mentioned vehicle lamp equipped with the hot airflow generating mechanism provides the function of melting snow as the vehicle lamp with heating wires. The hot airflow generating mechanism fully heats up the vehicle lamp and has problems of unconcentrated heating and large electricity consumption. Therefore, the snow attached to a main transmitting area of the lamp cover cannot be removed easily, and the light emitted from the vehicle lamp is blocked by the snow still attached to the lamp cover. The vehicle lamp hardly provides its original function of illumination or warning.

To overcome the shortcomings, the present invention provides a vehicle lamp to mitigate or obviate the aforementioned problems.

SUMMARY OF THE INVENTION

The objective of the invention is to provide a vehicle lamp to improve the problems of unconcentrated heating, failure to efficiently remove snow attached to the lamp cover, and high power consumption of the conventional vehicle lamp.

The vehicle lamp comprises a lamp housing, a light-emitting device, a fan, and an auxiliary heater. The lamp housing has a lamp base, a lamp cover, and an airflow circulating structure. The lamp cover is transparent, is mounted to the lamp base to form a chamber between the lamp cover and the lamp base, and has a main transmitting area. The airflow circulating structure is formed in the chamber between the lamp cover and the lamp base. The chamber is separated by the airflow circulating structure to form a circulation passage in the chamber and located at a position corresponding to the main transmitting area. The light-emitting device is mounted in the lamp housing and has at least one light-emitting diode module mounted in the chamber and located at a position corresponding to the main transmitting area of the lamp cover. The at least one light-emitting diode module is configured to emit light capable of passing through the circulation passage and the main transmitting area of the lamp cover and is configured to produce thermal energy when the at least one light-emitting diode module emits light. The thermal energy produced by the at least one light-emitting diode transfers into the circulation passage. The fan is mounted in the lamp housing for generating airflow inside the circulation passage. The auxiliary heater is mounted in the lamp housing and is adapted to be controlled to produce thermal energy inside the circulation passage. The airflow in the circulation passage generated by the fan is heated by the thermal energy produced from the auxiliary heater and the at least one light-emitting diode module and turns into thermal airflow to heat up the main transmitting area of the lamp cover.

The vehicle lamp has the following advantages:

1. Rapid and efficient removal of the snow attached to the main transmitting area of the lamp cover by intensive heating: The vehicle lamp of the present invention has the circulation passage being circular and formed by the airflow circulating structure disposed inside the lamp cover and corresponding to the main transmitting area in position, the fan for generating airflow inside the circulation passage, and the auxiliary heater and the light-emitting device for heating the airflow inside the circulation passage. The main transmitting area is evenly and intensively heated to make the snow attached to the lamp cover rapidly absorb thermal energy and melted and let the light emitted by the light-emitting device pass through the main transmitting area for illumination.

2. Reduced power consumption: With the arrangement of the vehicle lamp of the present invention, the snow is removed by heating the main transmitting area of the lamp cover rather than by heating the entire lamp cover as the conventional vehicle lamp, and thereby power consumption of the present invention is saved. In addition, the airflow continuously generated by the fan and circulating inside the circulation passage is not only heated by the auxiliary heater but is also heated by the light-emitting diode module when emitting light. Therefore, the thermal energy produced by the light-emitting diode module can be used in the present invention, and the additional thermal energy is saved to reduce the power consumption of the present invention.

Furthermore, the vehicle lamp of the present invention further comprises a temperature detector mounted in the lamp housing and located at a position away from the auxiliary heater, the temperature detector is configured to obtain a temperature value inside the circulation passage, and the auxiliary heater is switched according to the temperature value. When the temperature value in the circulation passage detected by the temperature detector reaches a default value, the auxiliary heater is controlled to be automatically switched off. The thermal energy produced by the lighting-emitting diode module during light emission keeps heating up the airflow inside the circulation passage, and thereby the power consumption of the present invention is further reduced.

When the temperature value in the circulation passage obtained by the temperature detector is lower than the default value, the auxiliary heater is controlled to be automatically switched on to heat up the airflow generated inside the circulation passage.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
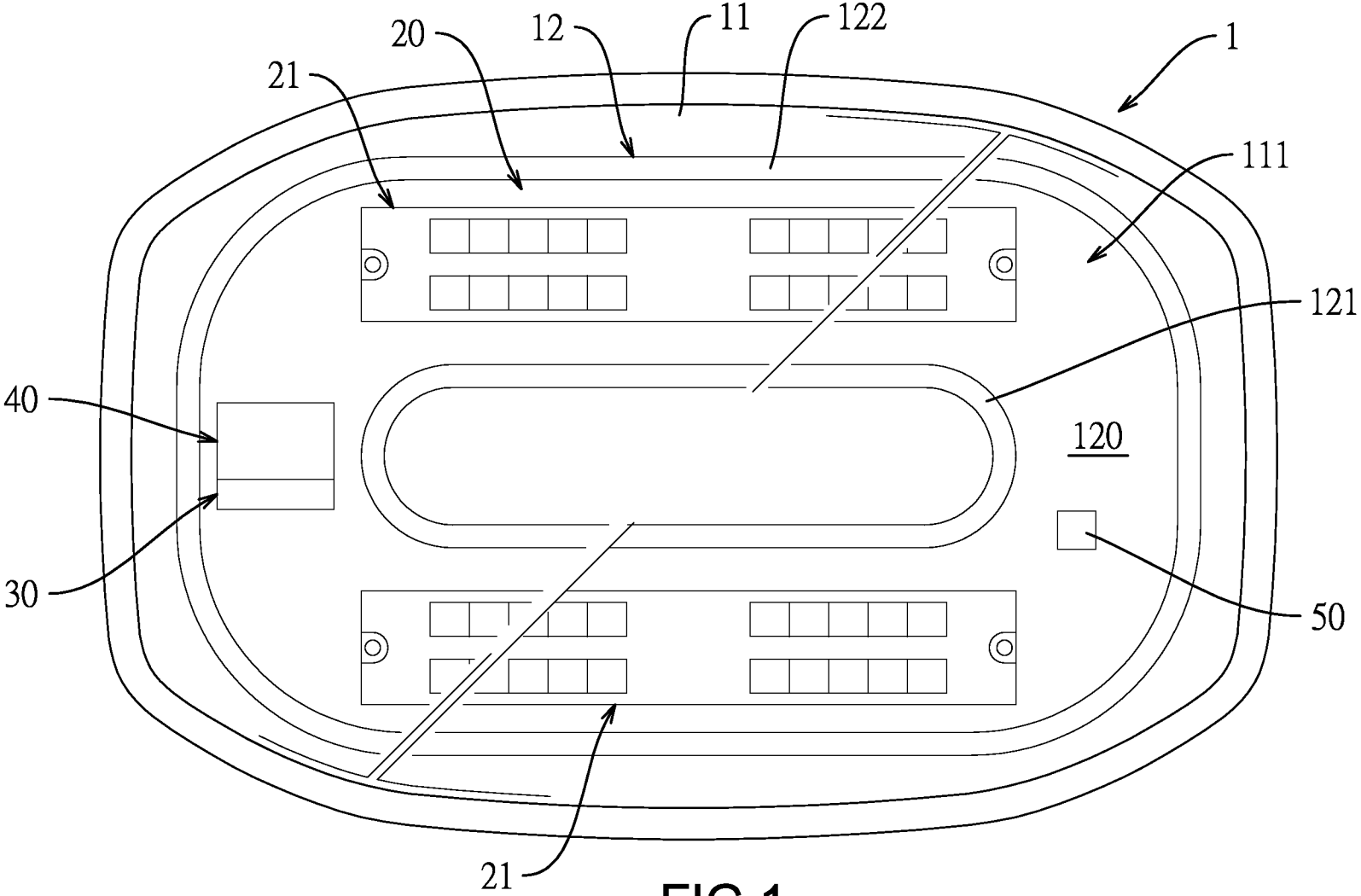
FIG. 1 is a front view of a vehicle lamp in accordance with the present invention.
Figure 2:
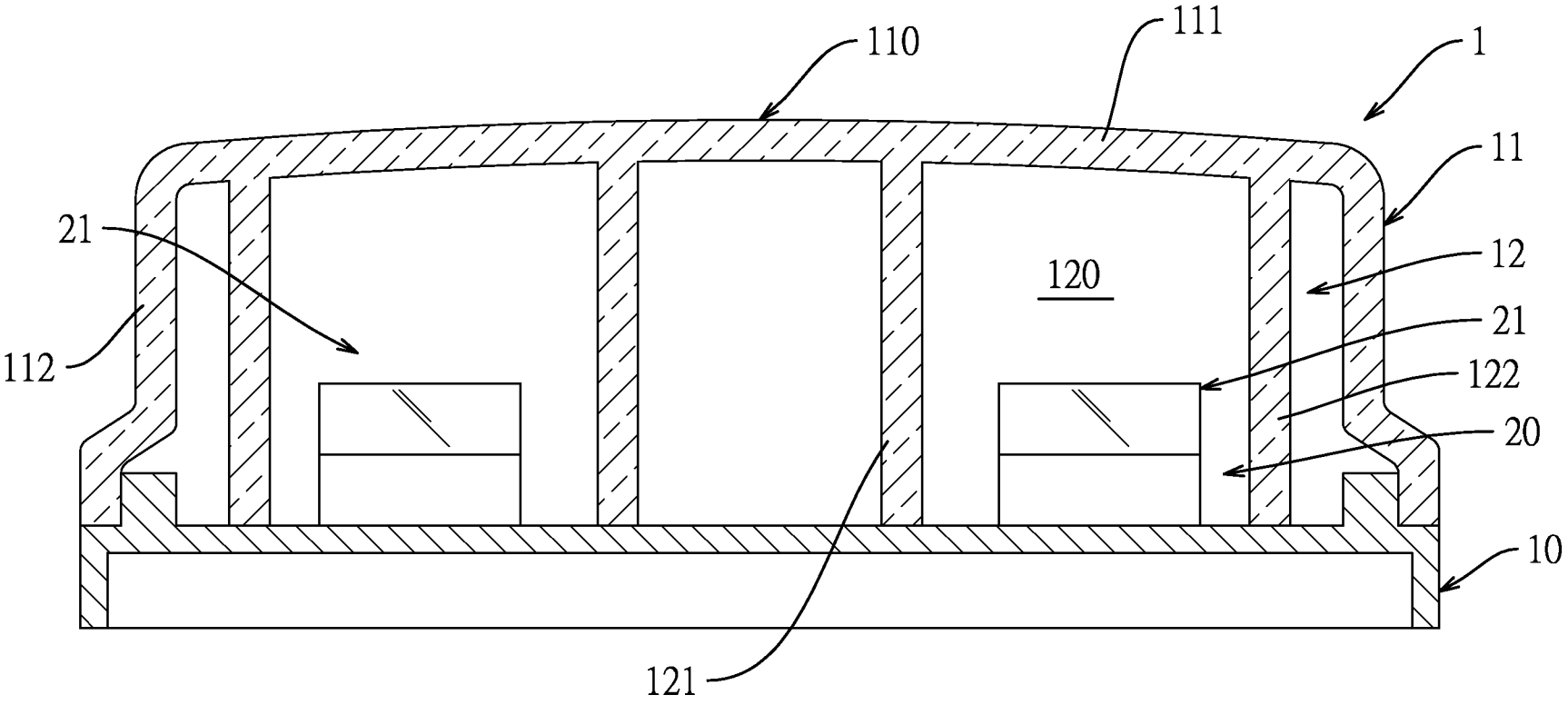
FIG. 2 is a cross sectional side view of the vehicle lamp in FIG. 1.
Figure 3:
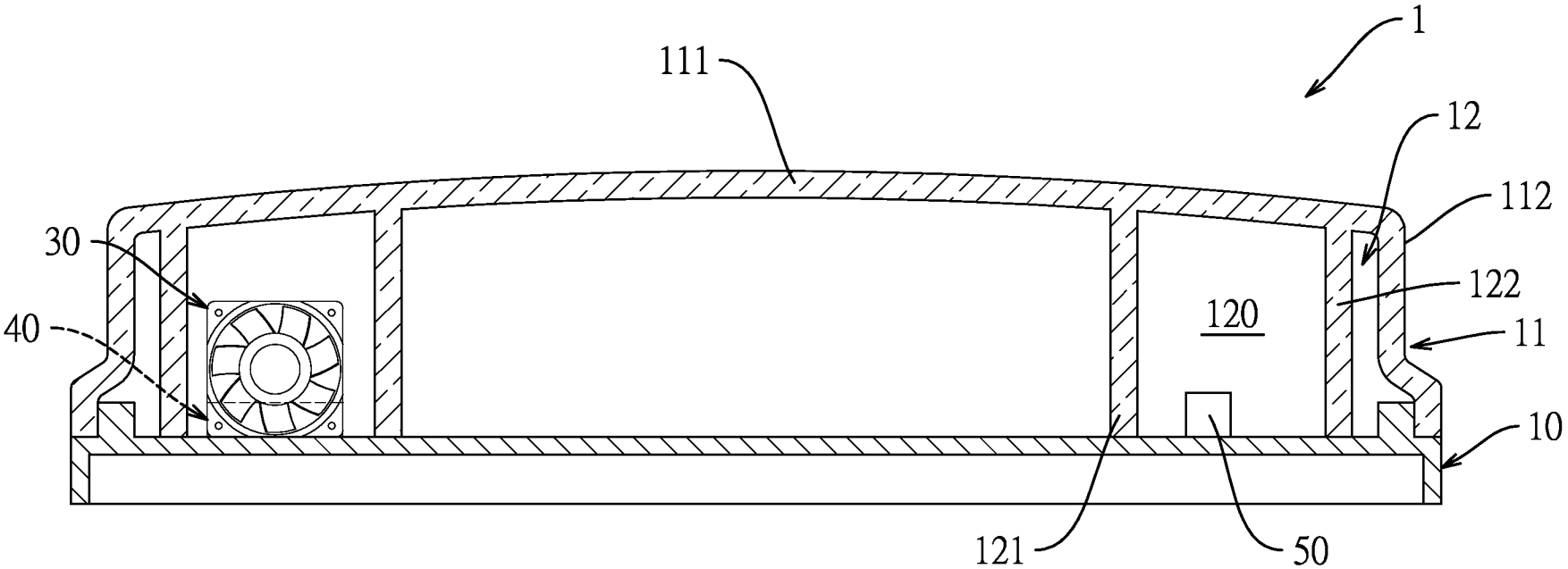
FIG. 3 is another cross sectional side view of the vehicle lamp in FIG. 1.

With reference to FIGS. 1 to 3, a vehicle lamp in accordance with the present invention comprises a lamp housing 1, a light-emitting device 20, a fan 30, and an auxiliary heater 40.

With reference to FIGS. 1 to 3, the lamp housing 1 has a lamp base 10, a lamp cover 11, and an airflow circulating structure 12. The lamp cover 11 is transparent and is mounted to the lamp base 10 to form a chamber between the lamp base 10 and the lamp cover 11. The lamp cover 11 has a main transmitting area 110 defined according to a lighting shape of the vehicle lamp. The airflow circulating structure 12 is formed in the chamber between the lamp base 10 and the lamp cover 11. The chamber is separated by the airflow circulating structure 12 to form a circulation passage 120 in the chamber. The circulation passage 120 and the main transmitting area 110 correspond in position.

With reference to FIGS. 1 to 3, in this embodiment, the lamp cover 11 has a main transmitting plate 111 and a peripheral wall 112 surrounding a rim of the main transmitting plate 111 and protruding from the main transmitting plate 111 toward the lamp base 10. The main transmitting area 110 is defined at the main transmitting plate 111. The main transmitting plate 111 is assembled to the lamp base 10 via the peripheral wall 112. The airflow circulating structure 12 is integrally formed on the lamp cover 11 and is transparent. The airflow circulating structure 12 protrudes from an inner surface of the main transmitting plate 111 toward the lamp base 10. In this embodiment, the airflow circulating structure 12 includes an inner annular wall 121 being annular and an outer annular wall 122 surrounding the inner annular wall 121. The circulation passage 120 is annular and is formed between the inner annular wall 121 and the outer annular wall 122. The inner annular wall 121 and the outer annular wall 122 of the airflow circulating structure 12 may be spaced from the lamp base 10.

With reference to FIGS. 1 to 3, the light-emitting device 20 is mounted in the light housing 1 and is secured to the lamp base 10. The light-emitting device 20 is electrically connected to an external power supplier and is adapted to be controlled to emit light. The light-emitting device 20 has at least one light-emitting diode module 21. Each of said at least one light-emitting diode module 21 comprises one or multiple light emitting diodes. The at least one light-emitting diode module 21 is located at a position corresponding to the main transmitting area 110 of the lamp cover 11. The light-emitting diode module 21 emits light passing through the circulation passage 120 and the main transmitting area 110 of the lamp cover 11. The light-emitting diode module 21 generates thermal energy during light emission. The thermal energy produced by the light-emitting diode module 21 transfers into the circulation passage 120.

With reference to FIGS. 1 to 3, the fan 30 is mounted in the lamp housing 1 and is located in the circulation passage 120. The fan 30 is adapted to be controlled to generate airflow inside the circulation passage 120.

With reference FIGS. 1 to 3, the auxiliary heater 40 is mounted in the lamp housing 1 and is adapted to be controlled to generate thermal energy transferring into the circulation passage 120. In this embodiment, the auxiliary heater 40 is located at an inlet side of the fan 30, so the thermal energy generated by the auxiliary heater 40 is spread by the fan 30.

With reference to FIGS. 1 to 3, the vehicle lamp in accordance with the present invention further comprises a temperature detector 50 mounted in the lamp housing 1 and located away from the auxiliary heater 40. The temperature detector 50 is configured to obtain a temperature value inside the circulation passage 120. The auxiliary heater 40 is able to be switched according to the temperature value.

Figure 4:
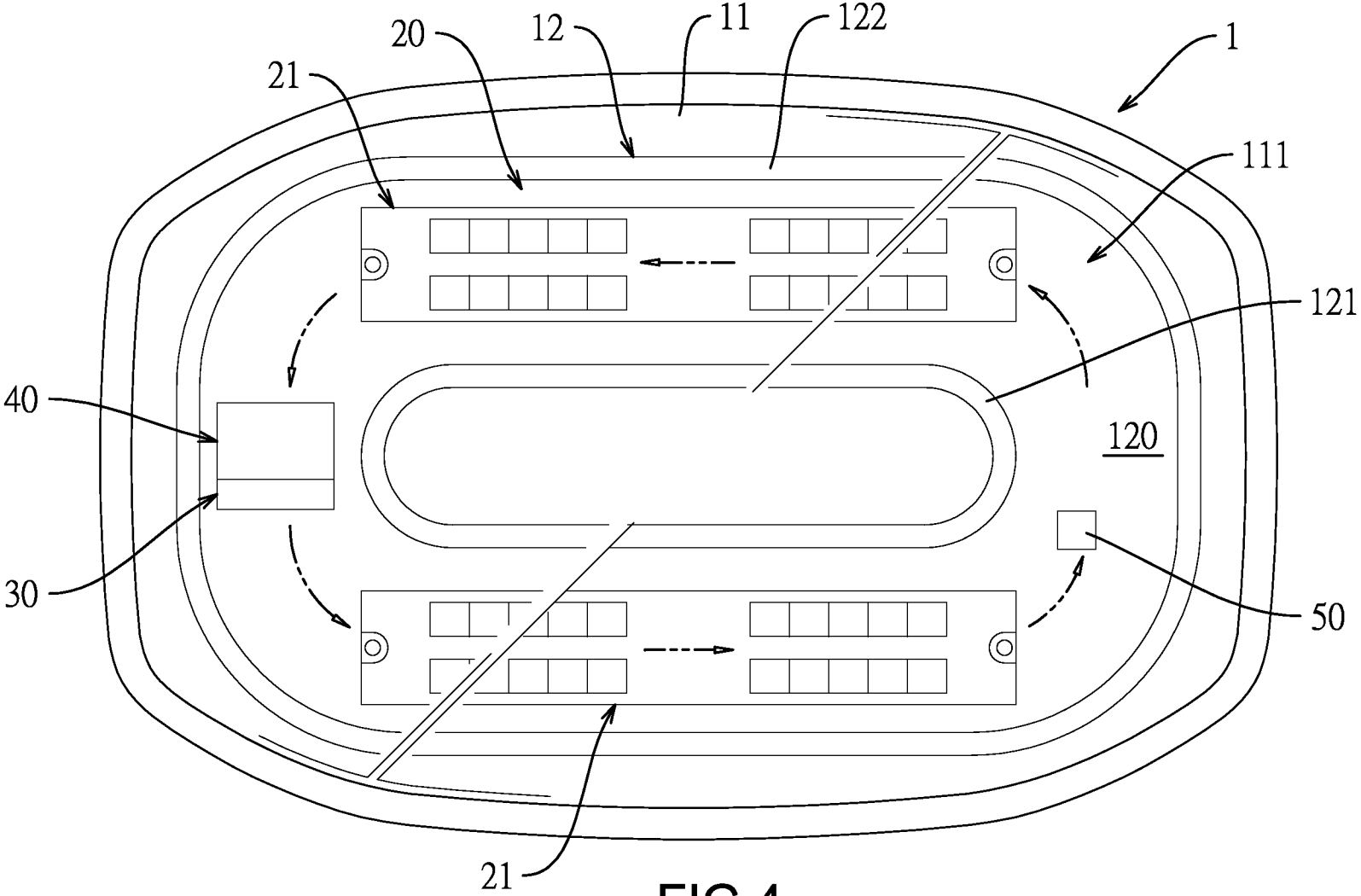
FIG. 4 is an operational front view of the vehicle lamp in FIG. 1.

With reference to FIGS. 2 to 4, when the vehicle lamp in accordance with the present invention is in use, the vehicle lamp is electrically connected to a control device and is controlled by the control device. The light-emitting device 20 is controlled to emit light. Light emitted by the light-emitting diode module 21 of the light-emitting device 20 transmits through the main transmitting area 110 of the lamp cover 11 for illumination.

In a snowy environment, the snow attached to the lamp cover 11 blocks the main transmitting area 110 of the lamp cover 11. When the vehicle lamp is controlled to illuminate, the auxiliary heater 40 and the fan 30 are turned on at the same time. The thermal energy generated by the auxiliary heater 40 is transferred into the circulation passage 120 in the lamp housing 1 and works with the airflow in the circulation passage 120 generated by the fan 30 to form a thermal airflow rapidly and cyclically flowing along the circulation passage 120. During flowing, the thermal airflow intensively heats up the main transmitting area 110 defined at the main transmitting plate 111 of the lamp cover 11, which corresponds to the circulation passage 120 in position. The snow attached to the main transmitting area 110 absorbs the thermal energy and is melted thereby. Accordingly, the light emitted by the light-emitting diode module 21 can transmit through the main transmitting area 110 for illumination.

During operation of the vehicle lamp, the auxiliary heater 40 continuously transfers thermal energy into the circulation passage 120 in the lamp housing 1. The light-emitting diode module 21 transfers thermal energy into the circulation passage 120 during light emission. With an assistance of the airflow generated by the fan 30 in the circulation passage 120, a thermal airflow is generated and continuously and cyclically flows along the circulation passage 120. During flowing, the thermal airflow heats up the main transmitting area 110 of the lamp cover 11, which corresponds to the circulation passage 120 in position. Whereby, the snow falling and attached to the main transmitting area 110 absorbs thermal energy and melts to let the light emitted from the said light-emitting diode module 21 pass through the main transmitting area 110 for illumination. Only the key portion, the main transmitting area 110, of the lamp cover 11 is heated for removing snow, so the power consumption of the present invention is reduced.

In addition, operation of the auxiliary heater 40 can be based on actual requirement. In the snowy environment, the auxiliary heater 40 can be controlled to continuously transfer thermal energy with the said light-emitting diode module 21. The thermal energy produced by the auxiliary heater 40 and the said light-emitting diode module 21 can be continuously transferred into the circulation passage 120.

In another condition, after the auxiliary heater 40 has been operating for a default time period, the auxiliary heater 40 is controlled to be turned off, and the fan 30 keeps generating airflow. The thermal energy produced by the said light-emitting diode module 21 is transferred into the circulation passage 120 to form the thermal airflow continuously and cyclically flowing along the circulation passage 120.

In another condition, after the auxiliary heater 40 has operated for a while, when the temperature value in the circulation passage 120 obtained by the temperature detector 50 reaches a default value, the auxiliary heater 40 is controlled to be turned off. The fan 30 keeps generating airflow, the thermal energy produced by the said light-emitting diode module 21 keeps being transferred into the circulation passage 120 to form the thermal airflow continuously and cyclically flowing along the circulation passage 120. So a proper amount of thermal energy can be transferred into the circulation passage 120. With the assistance of the fan 30, the thermal airflow keeps flowing along the circulation passage 120 corresponding to the main transmitting area 110 in position and heats up the main transmitting area 110 defined at the main transmitting plate 111 of the lamp cover 11. Whereby, the snow falling and attached to the main transmitting area 110 immediately absorbs the thermal energy to melt. The light emitted by the light-emitting diode module 21 passes through the main transmitting area 110 for illumination. When the temperature value in the circulation passage 120 detected by the temperature detector 50 is lower than a default value, the auxiliary heater 40 is automatically controlled to be turned on to transfer thermal energy into the circulation passage 120. Accordingly, the vehicle lamp in accordance with the present invention has an advantage of energy saving.

What is claimed is:

1. A vehicle lamp comprising:

a lamp housing having a lamp base;

a lamp cover being transparent, mounted to the lamp base to form a chamber between the lamp cover and the lamp base, and having a main transmitting area; and an airflow circulating structure formed in the chamber between the lamp cover and the lamp base; and the chamber separated by the airflow circulating structure to form a circulation passage in the chamber and located at a position corresponding to the main transmitting area;

a light-emitting device mounted in the lamp housing and having at least one light-emitting diode module mounted in the chamber and located at a position corresponding to the main transmitting area of the lamp cover, the at least one light-emitting diode module configured to emit light capable of passing through the circulation passage and the main transmitting area of the lamp cover and configured to generate thermal energy when the at least one light-emitting diode module emits light;

the thermal energy generated by the at least one light-emitting diode module transferring into the circulation passage;

a fan mounted in the lamp housing for generating airflow inside the circulation passage; and an auxiliary heater mounted in the lamp housing and adapted to be controlled to generate thermal energy inside the circulation passage, wherein the airflow in the circulation passage generated by the fan is heated by the thermal energy generated from the auxiliary heater and the at least one light-emitting diode module and turns into thermal airflow to heat up the main transmitting area of the lamp cover, wherein the lamp cover has a main transmitting plate; and a peripheral wall protruding from a rim of the main transmitting plate and assembled to the lamp base;

the main transmitting area is defined at the main transmitting plate; and the airflow circulating structure is integrally formed on the lamp cover, is transparent, and protrudes from an inner surface of the main transmitting plate toward the lamp base.

2. The vehicle lamp as claimed in claim 1, wherein the auxiliary heater is located at an inlet side of the fan.

3. The vehicle lamp as claimed in claim 1, wherein the vehicle lamp comprises a temperature detector mounted in the lamp housing and located at a position away from the auxiliary heater, the temperature detector is configured to obtain a temperature value inside the circulation passage; and the auxiliary heater is adapted to be switched according to the temperature value.

4. The vehicle lamp as claimed in claim 3, wherein the auxiliary heater is located at an inlet side of the fan.

5. The vehicle lamp as claimed in claim 1, wherein the airflow circulating structure includes an inner annular wall and an outer annular wall surrounding the inner annular wall; and the circulation passage is formed between the inner annular wall and the outer annular wall.

6. The vehicle lamp as claimed in claim 2, wherein the airflow circulating structure includes an inner annular wall and an outer annular wall surrounding the inner annular wall; and the circulation passage is formed between the inner annular wall and the outer annular wall.

7. The vehicle lamp as claimed in claim 3, wherein the airflow circulating structure includes an inner annular wall and an outer annular wall surrounding the inner annular wall; and the circulation passage is formed between the inner annular wall and the outer annular wall.

8. The vehicle lamp as claimed in claim 4, wherein the airflow circulating structure includes an inner annular wall and an outer annular wall surrounding the inner annular wall; and the circulation passage is formed between the inner annular wall and the outer annular wall.

* * * * *